United States Patent [19]

Charlins

[11] 4,453,489

[45] Jun. 12, 1984

[54] BOAT HULL WITH INVERTED CHINES

[75] Inventor: Richard J. Charlins, 949 Mercer Dr., Toms River, N.J. 08753

[73] Assignees: Richard J. Charlins; Carolyn A. Charlins, both of Toms River, N.J.

[21] Appl. No.: 89,622

[22] Filed: Oct. 29, 1979

[51] Int. Cl.[3] ..... B63B 1/32

[52] U.S. Cl. ..... 114/288

[58] Field of Search ..... 9/6 R, 6 P, 6 M, 6 W, 9/310 A; 114/56, 67 A, 288, 289, 290, 291, 292, 355, 356, 357, 358

[56] References Cited

U.S. PATENT DOCUMENTS

| | | | |
|---|---|---|---|
| D. 160,027 | 9/1950 | Smith | 114/290 |
| 1,084,401 | 1/1914 | Cooper | 114/289 |
| 3,216,389 | 11/1965 | Thorsen | 114/56 |
| 3,237,581 | 3/1966 | Moesly | 114/56 |
| 3,304,900 | 2/1967 | Greenwood | 114/290 |
| 3,388,446 | 6/1968 | Phillips | 9/6 M |
| 3,776,168 | 12/1973 | Weeks | 114/290 |

*Primary Examiner*—Trygve M. Blix
*Assistant Examiner*—Jesus D. Sotelo
*Attorney, Agent, or Firm*—Charles I. Brodsky

[57] ABSTRACT

A boat hull incorporating a plurality of pairs of longitudinal planing surfaces symmetrically positioned about the boat keel, and separated by inverted chines extending inwardly of the contour formed by the planing surfaces in providing the shape of the hull.

7 Claims, 6 Drawing Figures

BOAT HULL WITH INVERTED CHINES

FIELD OF THE INVENTION

This invention relates to boat hull configurations and, more particularly, to V shape hulls as find extensive use in pleasure speed boat designs.

BACKGROUND OF THE INVENTION

As is well known and understood, one of the more recent developments in speed boat design is the use of chines, or lifting strokes, to create added lift and permit increasing speeds to be attained. As is appreciated, these chines extend outwardly from the hull, and create a pressure pattern which lifts the boat out of the water, reducing the wetted surface contacted. Without the chines being present, the lifting of the boat would not occur, and it would not go as fast as possible, or be as efficient in operation. As is also understood, the types of chines presently available also improve the lateral stability of the vessel.

However, the pressure created, and the lift which results, also causes the boat to skid and slide when going into a turn. This makes the handling of the boat difficult in a turn, and presents a possibly dangerous situation. Also, the outwardly extending chines tend to restrict the re-entry of the vessel into the water when coming off a wave, causing a sudden slowing in its downward motion, and producing a hard ride. This latter pounding becomes more unendurable as the speed of the vessel increases and as the water conditions become choppier.

SUMMARY OF THE INVENTION

As will become clear hereinafter, the boat hull of the invention inverts these chines, or lifting strokes, inwardly of the hull, i.e. recesses them as a plurality of indentations, running fore and aft, equidistant from the keel. Triangular in configuration, the indentations will be seen to have substantially vertical and horizontal portions. As will be seen, variations can be made in the length of the chines, their distances from the keel, and their respective widths in accordance with the size, power and usage requirements of the vessel, and with the amount of lift desired at any given position on the hull. As will also be seen, the inverted chine can be employed to improve the handling and stability of a variety of hull bottom designs, and not necessarily only V-shaped hulls as are the concerns of the chines presently known.

BRIEF DESCRIPTION OF DRAWING

These and other features of the invention will be more clearly understood from a consideration of the following description, taken in connection with the accompanying drawing, in which.

DETAILED DESCRIPTION OF THE DRAWING

Figure 1:
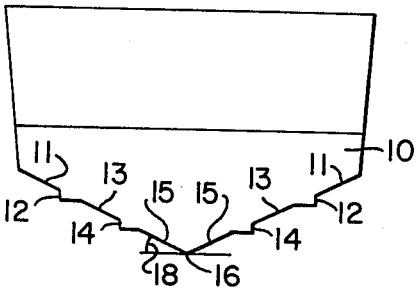
FIG. 1 PRIOR ART
FIG. 1 is a rear elevational view of a V-shape hull design of the type employing chines available in the prior art.

Referring to the rear elevational view of FIG. 1, the hull 10 is shown as incorporating pairs of longitudinal planing surfaces 11, 13, 15, and separated by pairs of chines, or lifting strokes, 12, 14, according to prior art designs. With both the planing surfaces and the chines being equally spaced with respect to the keel 16 (situated along the center line of the bottom of the hull), the chines 12 and 14 are in the form of a "step" which extends outside the contour of the V-shape hull formed by the planing surfaces, and run longitudinally, both fore and aft of the hull, parallel to the axis of the keel. The water passing beneath the step provides the lift to the vessel, reducing the wetted surface area in providing operation as the vessel moves forward at increasing speeds. However, the step configuration restricts the re-entry of the vessel into the water when coming off a wave, causing a sudden slowing of the downward motion and producing a hard ride. The angle 18 illustrates the degree of dead rise across the keel.

Figure 2:
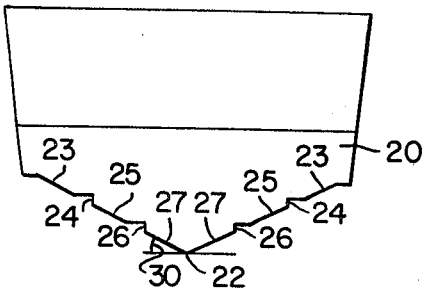
FIG. 2 is a rear elevational view of a V-shape hull design employing the inverted chines of the invention.
Figure 3:
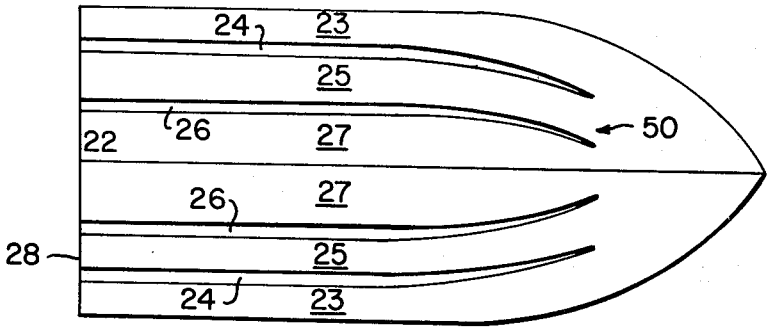
FIG. 3 is a bottom elevational view of a V-shape hull design illustrating two pairs of inverted chines helpful in an understanding of the invention.
Figure 4:
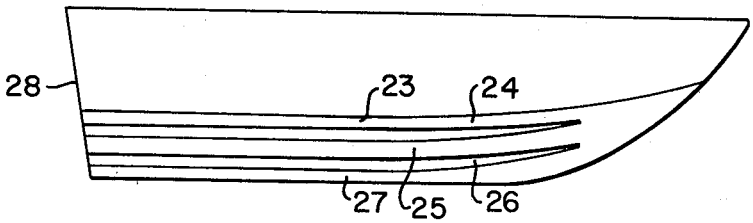
FIG. 4 is a side elevational view of a vessel having the hull design of FIG. 3.
Figure 5:
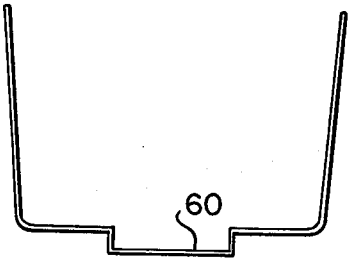
FIG. 5 is a rear elevational view of a vessel having a flat bottom hull design incorporating the inverted chines of the invention.

The rear elevational view of FIG. 2 illustrates a V-shape boat hull 20, having inverted chines, or lifting strakes, which extend inwardly of the contour formed by the planing surfaces 23, 25, 27. Also placed equidistant from the keel 22, these inverted chines 24, 26 are fabricated in the form of triangular indentations, again running fore and aft along the hull, parallel to the axis of the keel. More clearly shown in FIGS. 3 and 4, these inverted chines 24, 26 extend forwardly from the transom 28, to about the water line of the vessel at rest. In a 24 foot boat constructed to embody the invention, for example, these chines 24, 26 extend forwardly approximately 20 feet. Analysis has shown, that as the vessel moves forward, water continues to pass through the chines providing the necessary lift, thereby presenting less wetted surface, and an increased speed. But, because of the elimination of the outward extension of the "step" chine, the water passes through with substantially less restriction—insuring a much softer ride—and a substantial reduction in pounding exists as the vessel comes down off a wave. The angle 30 of FIG. 2 illustrates the degree of dead rise across the keel in the hull constructed according to the invention.

Experience with a boat having the hull of FIG. 2 has shown that the sides of the inverted chine (substantially vertical) act as a series of keels, to reduce the sliding action on a turn considerably. Experience has also shown that with the substantially horizontal portion of the chine recessed into the contour of the hull rather than extending from it, a softer riding boat results, even to the extent of giving a comfortable ride in heavy or choppy water. Experience has shown that with a 24 foot boat constructed according to the invention, easy rides, quite comfortable in nature, were had at 65 mile per hour speeds, even in rough waters. With vessels of such size constructed with the prior art chines, on the other hand, the ride had been found to be unendurably uncomfortable at speeds of 50 miles per hour in comparable waters, and with substantial skidding and sliding in the turns. Experience has shown that by recessing the chines, as in FIG. 2, a boat of 18° dead rise could give a ride in heavy or choppy water as comfortable as that of a 24° dead rise boat.

Also, it has been found that by tailoring the widths of the individual chines, a degree of control can be exerted even more over the restriction presented to the vessel when coming off a wave. More specifically, in accordance with one embodiment of the invention, the chine 26 was constructed slightly wider than the chine 24 (3¾ inches as compared to 3¼ inches), the narrowing of the outer chine being effective to create less restriction at that point, where no need for additional lift occurs. In the construction of one embodiment, the inverted chine—which could be employed in either wood, fibreglass, steel, or aluminum hulls—, was constructed to have a substantially vertical side approximately 2 inches in height.

With the boat hull fabricated as described above, it has been observed that the sides of the inverted chines serve as a series of individual keels, giving a high degree of lateral stability to the vessel. With the dimensions as previously set forth, the 24 foot boat embodying the invention was noted to track quite true, independent of the speed at which it was travelling, and with minimum handling of the wheel. With the inverted chines, furthermore, it was noted that the amount that the bow raised (even at the 65 mile per hour speed) was only about a 4 degree incline, while giving significantly better gas mileage. The lengths of the chines, and their distances from the keel, could be varied according to the size, usage, and power capabilities of the vessel—while the widths of the chines may be varied in accordance with the amount of lift desired at any given position on the hull.

Figure 6:
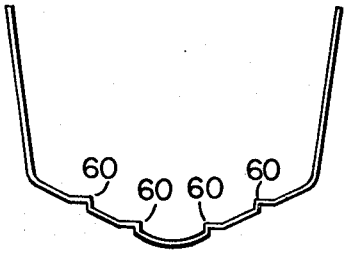
FIG. 6 is a rear elevational view of a vessel having a round bottom hull design illustrating the inverted chine concept.

FIG. 6 illustrate the inverted chine 60 on and a round bottom hull, and which also will result in an improvement in handling and stability characteristics. The outer-most chine, i.e., that which is most distant from the keel, may be rounded, or of the triangular indentation as described, depending upon the intended use of the vessel. Here, too, the placement of longitudinal chines recessed into the bottom of the hull improved its efficiency of operation by creating lift so as to reduce the wetted surface presented. Resulting in the improvement of handling and directional stabilities, the use of the inverted chine can lead to a far more comfortable ride than with the previous outwardly extending chine, thereby permitting a more efficient hull design and a possible lightening in weight without compromising comfort of ride in the waters.

While there have been described what are considered to be preferred embodiments of the present invention, it will be readily apparent that modifications may be made by those skilled in the art without departing from the scope of the teachings herein of separating the plurality of pairs of longitudinally extending planing surfaces used in forming a boat hull design by a series of inverted chines which extend inwardly of the contour so formed. For at least such reason, therefore, resort should be had to the claims appended hereto for a correct understanding of the extent of the invention.

I claim:

1. A boat hull having a bottom portion comprising:

a keel;

a plurality of pairs of longitudinal planing surfaces symmetrically displaced about said keel, with each successive planing surface on either side of said keel being of the same angularity outwardly from the keel as the next adjacent one in forming substantially co-linear contours thereof; and a plurality of chines separating said planing surfaces and extending inwardly of the contours formed thereby, in providing said hull shape;

wherein said chines and said planing surfaces run along axes substantially parallel to the longitudinal axis of said keel in providing the shape to said hull;

wherein said chines extend inwardly of the substantially co-linear contours formed by said planing surfaces for providing a lifting action to said hull as water passes therebeneath as said hull moves forward through the water;

wherein said chines extend inwardly of said contours by a predetermined amount according to the degree of lift desired in operation as said hull moves through the water; and wherein said chines are of a substantially triangular cross-section, having a horizontal leg which extends inwardly of said contour by said predetermined amount and at an angle parallel to the surface of the water through which the boat hull is moving.

2. The boat hull of claim 1 wherein said chines run from the transom towards the bow thereof, and wherein chines positioned nearer said keel are of a width greater than that of chines further from said keel.

3. The boat hull of claim 1 wherein said chines run from the transom towards the bow thereof by an amount sufficient to substantially meet the water line of said hull at rest.

4. The boat hull of claim 1 wherein the horizontal leg of said inwardly extending chine is of greater dimension than the vertical leg thereof.

5. The boat hull of claim 4 wherein the length of said horizontal leg substantially determines the amount of inward extension of said chines within said planing surface contour, and wherein said length is of the order of 3–4 inches.

6. The boat hull of claim 5 wherein the vertical leg of said chines is of the order of 2 inches in length.

7. The boat hull of claim 4 wherein said chines and said planing surfaces are so configured as to provide a substantially V-shape to the bottom portion of said hull.

* * * * *